US007473659B2

(12) United States Patent
Sytz

(10) Patent No.: US 7,473,659 B2
(45) Date of Patent: Jan. 6, 2009

(54) FIRE BARRIER FABRIC FOR USE WITH ARTICLES

(75) Inventor: Ronald Sytz, Gastonia, NC (US)

(73) Assignee: Murtzco, LLC, Great Falls, VA (US)

( * ) Notice: Subject to any disclaimer, the term of this patent is extended or adjusted under 35 U.S.C. 154(b) by 0 days.

(21) Appl. No.: 11/208,966

(22) Filed: Aug. 22, 2005

(65) Prior Publication Data

US 2007/0249251 A1 Oct. 25, 2007

(51) Int. Cl.

| | |
|---|---|
| ***D04B 1/22*** | (2006.01) |
| ***D04B 1/14*** | (2006.01) |
| ***D04B 7/24*** | (2006.01) |
| ***D04B 21/20*** | (2006.01) |

(52) U.S. Cl. ..... 442/312; 428/920; 428/921; 66/196; 66/202

(58) Field of Classification Search ..... 428/920, 428/921; 442/312

See application file for complete search history.

(56) References Cited

U.S. PATENT DOCUMENTS

| | | | | |
|---|---|---|---|---|
| 4,092,752 | A | 6/1978 | Dougan | |
| 4,504,991 | A | 3/1985 | Klancnik | |
| 5,578,368 | A | 11/1996 | Forsten | |
| 6,146,759 | A | 11/2000 | Land | |
| 6,410,140 | B1 | 6/2002 | Land | |
| 6,823,548 | B2 | 11/2004 | Murphy et al. | |
| 7,396,784 | B2 * | 7/2008 | Thiriot | 442/303 |
| 2004/0060120 | A1 | 4/2004 | Murphy et al. | |
| 2004/0062912 | A1 | 4/2004 | Mason et al. | |
| 2004/0097156 | A1 | 5/2004 | McGuire et al. | |
| 2004/0102112 | A1 | 5/2004 | McGuire et al. | |
| 2004/0106347 | A1 | 6/2004 | McGuire et al. | |
| 2004/0139552 | A1 | 7/2004 | Walters et al. | |
| 2005/0026528 | A1 * | 2/2005 | Forsten et al. | 442/414 |
| 2005/0097652 | A1 | 5/2005 | Rock et al. | |
| 2005/0115001 | A1 | 6/2005 | Horst | |
| 2006/0090272 | A1 * | 5/2006 | Mio et al. | 8/531 |
| 2007/0004302 | A1 * | 1/2007 | McKinnon et al. | 442/136 |

OTHER PUBLICATIONS

"Integral Defintion" from Dictionary.com website, printed Aug. 5, 2007.*

"Unitaryl Defintion" from Dictionary.com website, printed Aug. 5, 2007.*

* cited by examiner

*Primary Examiner*—Jenna-Leigh Johnson
(74) *Attorney, Agent, or Firm*—Triangle Patents, PLLC

(57) ABSTRACT

A fire barrier fabric further comprising a multilayer fabric having at least two layers, including an outside layer and a fire barrier layer; wherein the fire barrier layer provides flame-retardant and/or flame-resistant properties to the entire fabric without requiring fabric coatings or treatments to provide any contribution to flame retardance or resistance, wherein additional layers may include a filler layer, and wherein the fabric is applied to articles, such as upholstered articles and mattresses.

23 Claims, 2 Drawing Sheets

FIRE BARRIER FABRIC FOR USE WITH ARTICLES

BACKGROUND OF THE INVENTION (1) Field of the Invention

The present invention relates generally to fabrics and, more particularly, to a fire barrier fabric for covering articles to provide fire retardance or resistance.

(2) Description of the Prior Art

Generally, flame retardant fabrics of the prior art use flame retardant fibers, in particular nonwovens or knit fabrics that gain their primary functional flame retardance from chemical treatments. Also, multilayers are either applied as a separate layer or laminated to a decorative fabric. Thus, there remains a need for a unitary, integrally formed fire resistant fabric for applications on upholstered articles.

US Patent Application 20050115001: A coated fabric with a flame-resistant finish. It has an outer cover which is not integrated or unitary with the flame-resistant cover.

U.S. Pat. Nos. 6,553,749; 6,146,759; and 6,410,140: A yarn that we would use in our fire barrier layer. It does state that a total fabric could be made out of this yarn and be decorated but the hand of this yarn is not aesthetically pleasing and weight of the fabric is heavy. It is not a multi layer fabric.

US Patent Application 20050097652: A garment with three components laminated to each other. The layers are not integrated with each other.

U.S. Pat. No. 4,504,991: A fire barrier composite fabric created by laminating/bonding a fire retardant material to a fiberglass fabric, which creates a barrier fabric. This fabric is not decorated or integrated with another aesthetically pleasing fabric. The ticking actually covers this fabric.

U.S. Pat. No. 5,578,368: A combination of a fire resistant fiber with a fiberfill batt. The two are laminated, needle-punched etc together to combine. The fabric does not have an outer decorated fabric integrated into the fire barrier.

SUMMARY OF THE INVENTION

The present invention is directed to and provides a fire barrier for articles, including upholstered articles and mattresses. Preferably, the fire barrier fabric includes a multilayer fabric having at least two layers, including an outside layer and a fire barrier layer; wherein the fire barrier layer provides flame-retardant and/or flame-resistant properties to the entire fabric without requiring fabric coatings or treatments to provide any contribution to flame retardance or resistance. In a preferred embodiment of the present invention, the multilayer fabric includes three layers, including an outside layer, a filler layer, and a fire barrier layer. In any embodiment, the multilayer fabric is unitary and integrally formed and provides flame-retardant and/or flame-resistant properties to the entire fabric without requiring fabric coatings or treatments to provide any contribution to flame retardance or resistance.

The present invention is further directed to and includes a method for making the fire barrier fabric and covering articles with it to provide fire resistance or retardance therefor.

These and other aspects of the present invention will become apparent to those skilled in the art after a reading of the following description of the preferred embodiment when considered with the drawings.

DETAILED DESCRIPTION OF THE INVENTION

Figure 1:
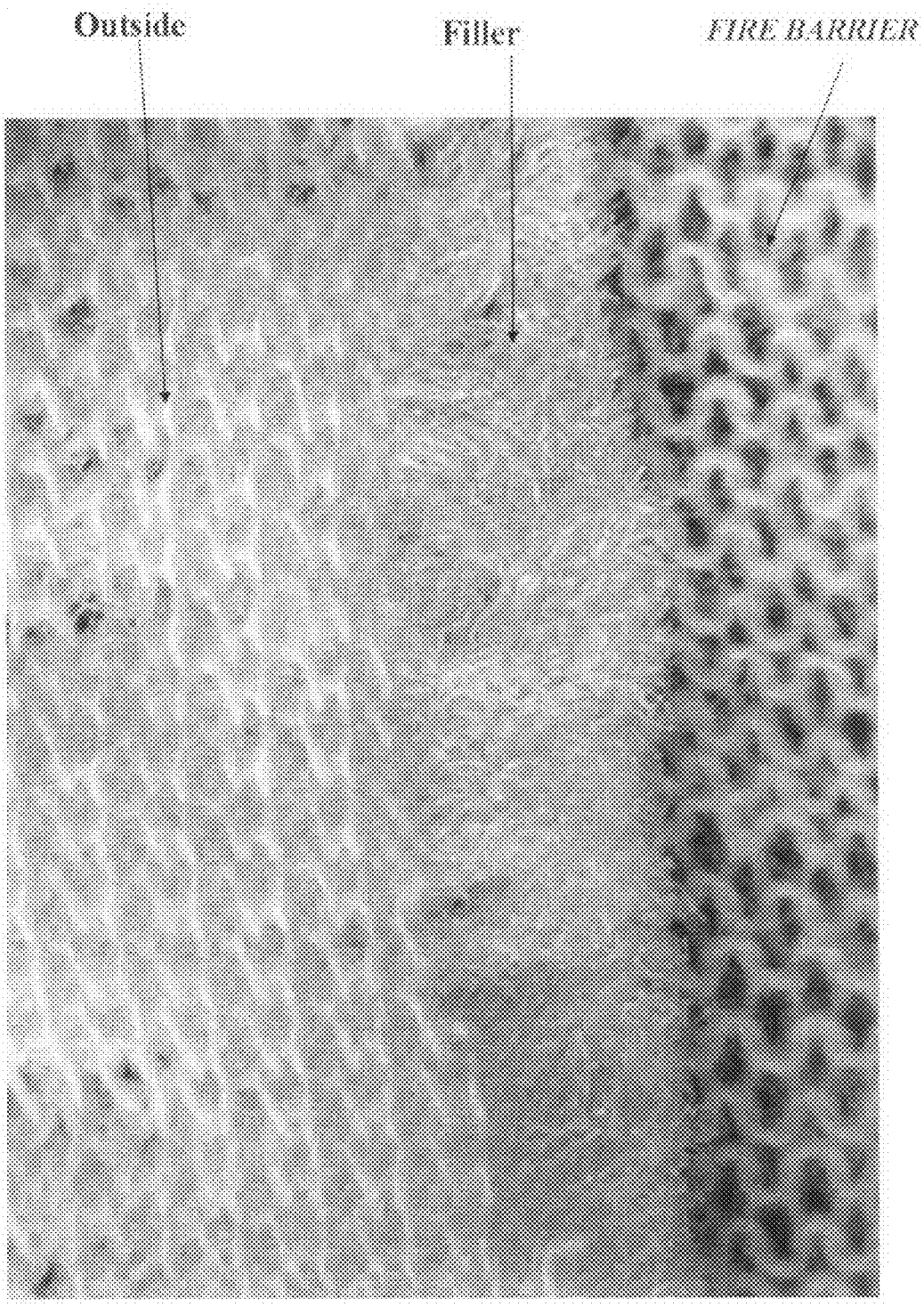
FIG. 1 is a digital photographic top view of a fire barrier fabric constructed according to one embodiment of the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 2:
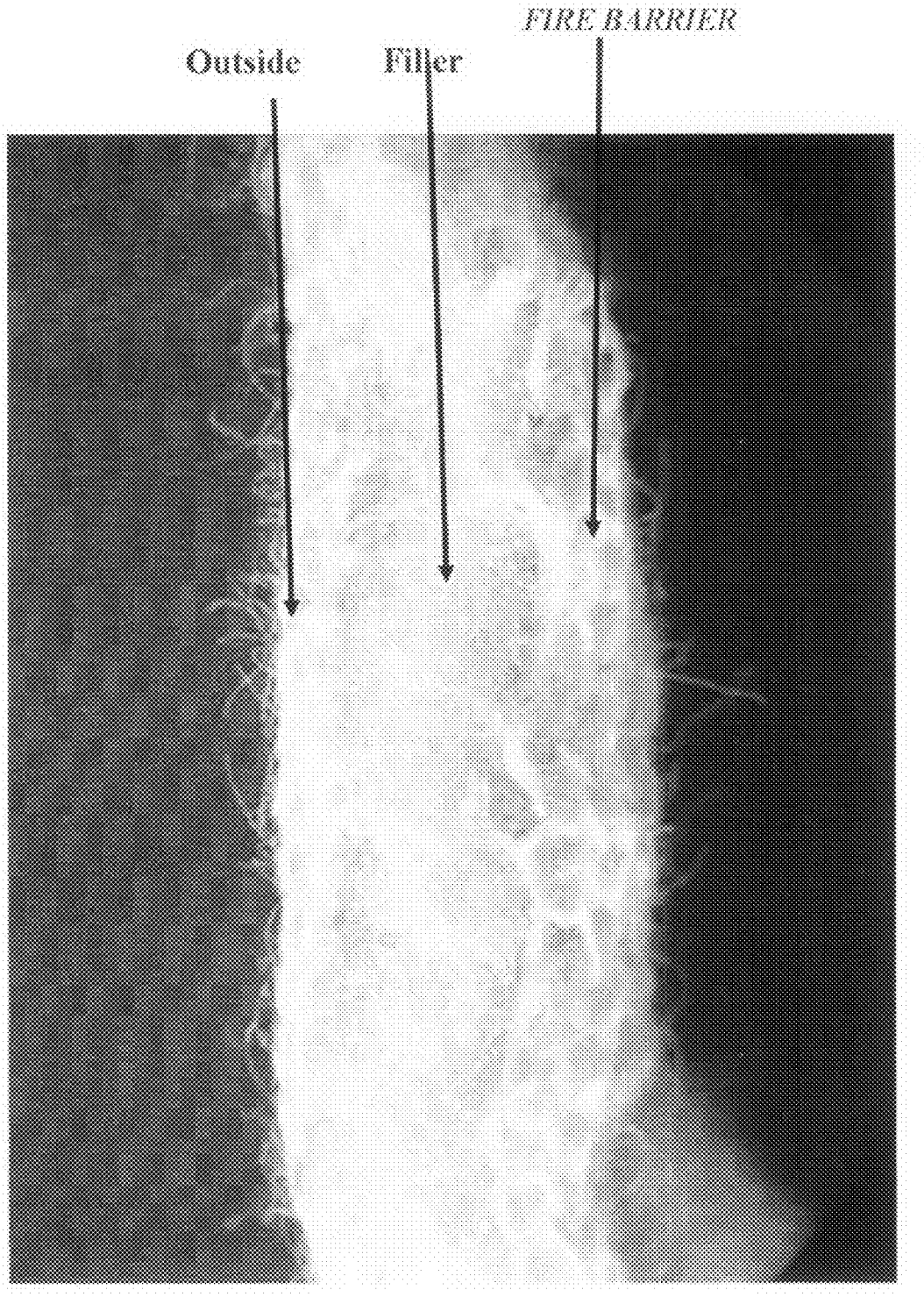
FIG. 2 is a digital photographic cross-sectional view of a fire barrier fabric constructed according to one embodiment of the present invention.

Referring now to the drawings in general, the illustrations are for the purpose of describing a preferred embodiment of the invention and are not intended to limit the invention thereto. As best seen in FIGS. 1 and 2, a unitary, integrally formed fire barrier fabric is shown. The present invention provides a multilayer fabric having at least two layers, a fire barrier layer and an outside layer; the figures show a three layer fabric having a fire barrier layer, an outside layer and a filler layer.

The present invention provides fire barrier fabrics that cover and/or at least partly enclose upholstered furniture articles, mattresses, including articles filled with resilient cushioning materials, and the like, to provide fire retardant and/or fire resistant properties or resistance to open flame ignition sources. More particularly, the fire barrier fabrics are multilayer fabrics having at least two layers and preferably three layers, preferably an outside layer, a filler layer, and a fire barrier layer. In preferred embodiments of the present invention, these multilayer fabrics have unitary, integrally formed layers to prevent delamination or uneven wear or protection during application to upholstered furniture, seating, mattresses or other cushioned articles, or during normal use of such items.

FIG. 1 is a digital photographic representation of the fabric of the present invention, showing a top view with layers exposed individually to show the multilayer fabric having an outside layer, a filler layer, and a fire barrier layer. FIG. 2 shows another digital photographic representation of the fabric shown in FIG. 1, but in a cross-sectional view with each of the three layers visible.

In furniture and other non-mattress applications of the fabric according to the present invention, at least two layers and preferably two layers or lightweight or thin three layers may be used, in particular because drape and conformability to shapes of upholstered furniture require thin, conformable and not so much padded covering material.

Flame or fire retardance or resistance is provided entirely by the fabric of the present invention. Any resistance of the encased article of upholstered furniture seating, mattresses or other cushioned articles to ignition after exposure to an open flame is provided entirely by the fabric itself. Thus testing of an article enclose or covered with the fabric of the present invention will provide test results associated directly and exclusively with the fabric itself, such as testing in accordance with California Technical Bulletin 133, TB117, ASTM E-1537, NFPA 266 or the methods outlined in the CPSC Staff Draft Standard for Upholstered Furniture Flammability (May 2005), to assess performance of full-scale composite furniture items and mock-ups against open flame ignition sources. Test protocols of each of these standards are widely available and the entire contents of each test method are incorporated herein by reference. Results of testing a mattress article according to the present invention according to such test protocols typically show a maximum heat release rate of less than 250 kW and a total energy release of less than 40 MJ in the first five minutes of each test. In some embodiments of the present invention, improved protection is provided, as follows: maximum heat release rate of less than 100 kW, total heat release of less that 25 MJ in the first ten minutes of the test and weight loss due to combustion of less than 3 pounds in the first ten minutes of the test.

By way of example and not limitation, multilayer fabric embodiments according to the present invention include single knit including terry velour, double knit, warp knit, and woven fabrics, such as 3-dimensional woven fabrics. Nonwovens are not preferred because they require lamination in a separate step, which increases the handling, processing, and risk of delamination, while reducing the hand and drapability of the fabric, which is undesirable, in particular for upholstered applications. The outside or technical face of the fabric is comprised of non-FR enhanced (standard) yarns comprised of standard yarn types used to decorate the face of the fabric, the middle filling material component is comprised of textured polyester, nylon yarns or other similar yarns and the inside layer is comprised of yarns comprised of inherently flame retardant materials and fibers that create the fire barrier element to the fabric. Alternative embodiments eliminate the inside layer or replace the inside layer materials with standard materials, as long as at least one outside layer includes flame resistant or flame retardant fibers. The present invention provides more aesthetically pleasing fibers on the outside and only have inherently fire retardant fibers on the inside away from the side that may touch the person. Further alternative embodiments could be to create a double jersey knit without filling material, locating the yarns of inherently flame retardant materials or fibers to the inside face—the outside face being the side of the fabric to which texture or design could be rendered to enhance the aesthetic appeal of the fabric, including but not limited to branding or other commercial marking to identify manufacturer, distributor, or reseller brand(s), including text and image or logo branding. This design aspect can be on three layers or two. When knitting the structure, the fire barrier layer is actually integrated with and attached structurally to the at least one other layer of the multilayer fabric. Thus, the layers are structurally connected and integrated with each other to eliminate the possibility of delamination and maintain the integrity of the fire barrier layer with respect to any other layers and overall coverage of the article, in particular the outside surface coverage.

The yarns used to create the fire barrier layer of the multilayer fabric are selected from all available yarn formation techniques and are not limited in size or formation. Yarns may be ring, openend, worsted, airjet, vortex, or any other technique of spinning staple yarns, these yarns may be used by themselves or in addition to flat or textured filament yarns or combined using techniques of plied, plated, corespun, alternated, or any other yarn spinning technique that could be used to combine fibers.

The fire barrier fabric of the present invention includes flame-retardant or flame-resistant fibers in the fire barrier layer. Preferably, this fire barrier layer includes at least one char-forming, inherently flame-retardant fiber.

The outside layer of the fabric can decorated with pattern designs. The invention is to have a decorated mattress or upholstery fabric that includes the fire barrier layer.

A fire barrier fabric according to the present invention functions to protect a mattress, covered or upholstered furniture article, or padded/cushioned article and/or foundation from fire by forming a char when exposed to an ignition source. In the context of the present invention, the term 'char' is defined as a residue formed from material that has been exposed to heat and/or flame, and which is no longer flammable. The char may be formed from materials that have been incompletely burned and extinguished, or from materials that do not react chemically under conditions found in a fire, and so, are not flammable, such as fiberglass. The char may also possess mechanical strength and integrity and so can act as a physical barrier to prevent flames from contacting highly combustible interior fill components of mattresses and mattress foundations. In addition, it is desirable that the char should not melt, drip or shrink away from the ignition source, or display significant after-flame, or support these reactions at a level sufficient to cause ignition of adjacent materials.

Accordingly, the fire barrier layer of the fire barrier fabric of the present invention includes at least one char-forming flame-retardant fiber. The fire barrier layer may be formed using a single fiber or a multiplicity, combination, or blend of fibers. Any char-forming flame retardant fiber may be used for the fire barrier layer, and the following fibers have been found to be particularly useful: aramids, including para-aramids (poly(p-phenylene terephthalamide), e.g., KEVLAR® (Dupont Corporation) and TWARON® (Teijin Twaron BV) and meta-aramids (poly(m-phenylene isophthalamide), such as Nomex® (Dupont Corporation) and Conex® (Teijin Twaron BV); fiberglass; melamines such as BASOFIL® (BASF/Mckinnon-Land-Moran, LLC); poly-benzimidazole (PBI) (Celanese Acetate A.G); oxidized polyacrylonitrile (PAN); novoloids, such as KYNOL® (American Kynol, Inc); pre-oxidized fibers and carbon fibers, modacrylics, such as, e.g., KANECERON® and PROTEX® (Kaneka), SEF (Solutia) and LUFNEN® (Kanebo Goshen), FR (fire- or flame-resisting, -resistant, -retarding or -retardant) rayon, FR viscose, such as, e.g., VISIL® (Sateri Oy) and LENZING FR® (Lenzing AG, Fibers Division), wool and FR-treated cotton. It should be noted that these fibers are merely exemplary, and other fire-retardant fibers that form a char, including fibers that are developed in the future may be used. Additionally, certain proprietary modacrylic fibers that release extinguishing/oxygen depriving elements such as antimony when exposed to an ignition source may be used. This chemical reaction may assist in snuffing out small flames that may occur on adjacent, non-FR components such as the mattress covering fabric or ticking. Blends that include at least one fire-retardant fiber that form a char may also be used. The blends may include one or more structure-providing char-forming fire-retardant fibers, FR-treated fibers, such as FR-treated polyester, and non-FR fibers. For example, in one embodiment, the fire barrier layer is composed of a blend of aramid and modacrylic fibers and the thermally insulating layer is composed of a blend of FR viscose and modacrylic fibers. Aramid-modacrylic blends typically contain 5-25% para-aramid fiber and 75-95% modacrylic fiber, and flame-retardant viscose-modacrylic blends, 50-75% FR Viscose and 25-50% modacrylic fibers. Non-flame-resistant polyester is typically used as a carrier fiber for manufacturing fiberglass fabrics, and these fabrics may contain 10% of a polyester fiber, and up to 50% of that fiber.

Flame retardant fibers that form a char and provide structure to that char include high temperature fibers such as the aramids, fiberglass, melamines, PBI, oxidized PAN, novoloids, pre-oxidized fibers and carbon fibers. These are capable of forming a char having mechanical integrity that can remain in place to protect adjacent materials from the ignition source, and provide a structural support for char or other residue formed from other fibers blended with or otherwise combined therewith.

In some embodiments, the fire barrier layer may include either high temperature fibers that are inherently flame and heat resistant and promote char formation and char integrity or fibers that simply promote char formation.

The long-term durability of the fire barrier fabric may be evaluated as measured by Rollator (ASTM F1566) testing.

Specific design parameters, such as weight of the finished fabric, weight of the fire barrier layer and of the standard materials, blend levels of fibers for each of the components, yarn size, yarn construction and choice of textile construction, are not critical. Weight of effective fire barrier fabrics typically includes fire barrier layer weight ranges between about_1 ounce per sq. yard and about_6 ounces per sq yard, depending on the severity of the test to which performance is being judged and the protective challenge required for different mattress, furniture or filled article constructions are based on the fuel load they represent, a range of configurations and combinations of elements that make up fire barrier fabrics. The example test included about 2.9 oz per square yard fire barrier layer with medium range filler layer making the overall fabric weight about 8.4 oz per square yard. Overall fabric weight depends mostly on the amount of filler material, which varies by application.

Topical treatments or processing, such as coating, are possible to add to the fire barrier fabrics according to the present invention, but no finishing is required to provide the fire retardance or fire resistance. Other treatments or processing is preferably directly to increasing other properties of the fabric not related to fire retardance or fire resistance. Other topical treatments for aesthetic or anti-bacterial properties include finishing processing, such as bleaching, dyeing, scouring, heat-setting, pre-shrinking. However, significantly, the untreated state of the fabric provides the functional fire-resistance or retardance because of the fire resistant layer alone. If finishing were desired, such would not materially affect performance of the fabric A typical design approach for residential mattresses is to localize comfort elements, such as polyurethane foams and battings, in the sleep surface areas (panels), with a minimum of fabric in the borders or sides. Accordingly, the fire barrier fabric according to the present invention at least partially encloses the core of the mattress, and the core may be fully enclosed, if desired, as flame retardant performance may be achieved without loft or thickness being so high as to hinder the ability of the mattress manufacturer to completely encapsulate the fuel load with the fire barrier fabric. Fire barrier fabric having different compositions, typically varying according to weight of the fire barrier layer or the thermally insulating layer, may be used to cover different areas of the mattress or mattress foundation. The cover contemplated by the present invention joins individual pieces of fire barrier fabric or creates seams with sewing thread specifically designed to withstand ignition, typically para-aramid or fiberglass sewing thread.

The fire barrier fabric of the present invention is designed to address variable flammability of decorative exterior cover that are not removed by the enduser/consumers during installation, not just the filling materials that are protective by conventional approaches to barrier design.

EXAMPLES

Example 1

Fabric Manufacture

Several versions of the fabric were manufactured. Compositions of the fire barrier fabrics manufactured are listed in Table 1.

| Ex. no. | Fabric type | Weight, oz/sq. yd | Fabric Composition |
|---|---|---|---|
| 1.1 | Double Knit | 8.3 | Outside - Cotton<br>Middle - Textured Polyester<br>Inside (FB) - Kevlar ® Protex ® Modacrylic Blend |
| 1.2 | Double Knit | 6.86 | Outside - Cotton<br>Middle - Textured Polyester<br>Inside (FB) - Fiberglass Protex ® Modacrylic Polyester Blend |
| 1.3 | Double Knit | 7.0 | Outside - Cotton<br>Middle - Textured Polyester<br>Inside (FB) - Fiberglass VISIL ® Polyester Blend |
| 1.4 | Double Knit | 8.4 | Outside - Cotton<br>Middle - Textured Polyester<br>Inside (FB) - Corespun Fiberglass with Protex ® Modacrylic Wrapper |
| 1.5 | Double Knit | 7.95 | Outside - Polyester<br>Middle - Textured Polyester<br>Inside (FB) - Corespun Fiberglass with Protex ® Modacrylic Wrapper |
| 1.6 | Double Knit | 6.86 | Outside - Polyester<br>Middle - Textured Polyester<br>Inside (FB) - Corespun Fiberglass with Protex Modacrylic Wrapper |
| 1.7 | Double Knit | 7.76 | Outside - Polyester<br>Middle - Textured Polyester<br>Inside (FB) - Corespun Fiberglass with Protex ® Modacrylic Wrapper |
| 1.8 | Double Knit | 9.24 | Outside - Polyester<br>Middle - Textured Polyester<br>Inside (FB) - Corespun Fiberglass with Protex ® Modacrylic Wrapper |
| 1.9 | Double Knit | 9.2 | Outside - Cotton<br>Middle - Textured Polyester<br>Inside (FB) - Corespun Fiberglass with Protex ® Modacrylic Wrapper |

KEVLAR ® is a para-aramid fiber available from DuPont
PROTEX ® is a modacrylic fiber obtained from Kaneka Corporation
VISIL ® is a FR-viscose fiber obtained from Sateri OY, Valkeakoski Finland

Example 2

Full-Scale Open Flame Testing

Procedure

A mattress core measuring 72"×36"×6" comprised of visco-elastic and polyurethane foam material was selected to build a mattress.

Example No. 1.4 of the fabric embodiments recited above was used and left in its tubular form and greige state. No finishing or treatment was applied to the fabric.

Using conventional design techniques a cover that fully encased the selected core was fashioned. All seams were closed using Kevlar® sewing thread of size Tex 50 as manufactured by Saunders Thread Company. The cover was installed over the core prior to final closing of the seams and once installed the final seams were closed with the Kevlar thread. An alternative embodiment would be to use a zipper to facilitate consumer installation.

A mattress with a fire barrier fabric cover was tested in accordance with California Technical Bulletin 603, Option C Room Configuration. All instrumentation was zeroed, and calibrated prior to testing. The test specimen, after conditioning for 48 hours at 70° F. +/−5° F. and no more than 55% Relative Humidity, was placed on a metal test frame. The test was conducted according to the test protocol of TB603 which is hereby incorporated herein in its entirety by reference.

Data recorded included: room smoke opacity; weight loss; smoke release rate (SRR); total smoke release (TSR); carbon monoxide concentration; heat release rate (HRR); total heat release (THR); ceiling temperature above specimen; and temperature at 4 feet above floor, 3 feet out from center of specimen.

TABLE 2

TB 603 Test Results - Full-scale Mattress

| Description of Specimen | | | | | |
|---|---|---|---|---|---|
| Example No. | Fire Barrier | Mattress Core Type | Foundation? | Results | Comments |
| 2.1 | Double Knit with filling material No 1.4 | Vicso elastic polyurethane foam core | No | Pass | Ceiling Temp Max - 161 F. Peak Heat Release - 21 kW Total Heat Release (1st 10 Min) - 3.5 MJ |
| 2.2 . . . | Run more test - pillow to TB604, Furniture to TB133 | | | | |

A fire barrier fabric according to the present invention may also be used in other applications where it is desired to protect an upholstered or otherwise padded or filled article from heat of flames. Examples of applications include upholstered furniture including articles such as a chair, sofa, chaise, ottoman, stool, headboard, wall covering, office wall divider, and combinations thereof, and transportation and health care seating systems, where filling materials may be partly or completely enclosed by a fire barrier fabric according to the invention. Transportation seating systems include seats for airplanes, trains and buses and health care seating systems include seats or cushions for wheelchairs. Another example is protective apparel, such as firefighter turnout gear, where the filling materials may be covered by a fire barrier fabric. Performance of upholstered materials may be evaluated using the protocol set forth in California Technical Bulletin 133.

Certain modifications and improvements will occur to those skilled in the art upon a reading of the foregoing description. All modifications and improvements have been deleted herein for the sake of conciseness and readability but are properly within the scope of the following claims.

What is clamed is:

1. A fire barrier fabric comprising:

a multilayer knitted fabric, made from a knitting process, including a knitted non-flame retardant and/or non-flame resistant outside layer, a non-flame retardant and/or non-flame resistant filler layer, and a knitted fire barrier layer, the multilayer knitted fabric being unitary and integrally formed, such that the outside layer is knitted together with the fire barrier layer during the knitting process such that the multilayer knitted fabric does not require additional stitching to maintain structural integrity; wherein the fire barrier layer provides flame-retardant and/or flame-resistant properties to the entire fabric without requiring fabric coatings or treatments to provide any contribution to flame retardance or resistance.

2. The fire barrier fabric of claim 1, wherein the fire barrier layer further comprises fame-resistant fibers.

3. The fire barrier fabric of claim 1, wherein the fire barrier layer further comprises substantially non-burning, char-forming, flame retardant fibers.

4. The fire barrier fabric of claim 1, wherein the fabric when applied to a mattress has a maximum heat release rate of 200 kW within first five minutes of testing in accordance with ASTM E 1590 testing.

5. The fire barrier fabric of claim 1, wherein the fabric when applied to a mattress has a total energy release of less than 25 MJ within first five minutes of testing in accordance with ASTM E 1590 testing.

6. The fire barrier fabric of claim 1, wherein the fabric meets or exceeds minimum requirements in testing in accordance with California Technical Bulletin TB 117.

7. The fire barrier fabric of claim 1, wherein the fabric when applied to a upholstered article meets or exceeds minimum requirements in testing in accordance with California Technical Bulletin 133, TB117, ASTM E-1537, NEPA266 and/or the methods outlined in the CPSC Staff Draft Standard for Upholstered Furniture Flammability (May 2005).

8. The fire barrier fabric of claim 1, wherein the fabric when applied to a mattress meets or exceeds minimum requirements in testing in accordance with proposed federal testing rules as set forth in California Technical Bulletin #603.

9. The fire barrier fabric of claim 1, wherein the fabric when applied to a mattress meets or exceeds minimum requirements in testing in accordance with proposed federal testing rules as set forth in 16 CFR 1633.

10. The fire barrier fabric of claim 1, wherein the fabric further includes a decorative outside layer.

11. A mattress ticking with fire resistance comprising:

a fire barrier fabric further comprising a multilayer knitted fabric, made from a knitting process, including a knitted non-flame retardant and/or non-flame resistant outside layer, a non-flame retardant and/or non-flame resistant filler layer, and a knitted fire barrier layer, the multilayer knitted fabric being unitary and integrally formed, such that the outside layer is knitted together with the fire barrier layer during the knitting process such that the multilayer knitted fabric does not require additional stitching to maintain structural integrity; wherein the fire baffler layer provides flame-retardant and/or flame-resistant properties to the entire fabric without requiring fabric coatings or treatments to provide to flame retardance or resistance.

12. The mattress ticking of claim 11,wherein the fire barrier layer further comprises flame-resistant fibers.

13. The mattress ticking of claim 11, wherein the fire barrier layer further comprises substantially non-burning, char-forming, flame retardant fibers.

14. The mattress ticking of claim 11, wherein the fabric when applied to a mattress has a maximum heat release rate of 200 kW within first five minutes of testing in accordance with ASTM E 1590 testing.

15. The mattress ticking of claim 11, wherein the fabric when applied to a mattress has a total energy release of less than 25 MJ within first five minutes of testing in accordance with ASTM E 1590 testing.

16. The mattress ticking if claim 11, wherein the fabric further includes a decorative outside layer.

17. An upholstered article with fire resistance comprising:

a fire barrier fabric further comprising a multilayer knitted fabric, made from a knitting process, including a knitted non-flame retardant and/or non-flame resistant outside layer, a non-flame retardant and/or non-flame resistant filler layer, and a knitted fire barrier layer, the multilayer knitted fabric being unitary and integrally formed, such that the outside layer is knitted together with the fire barrier layer during the knitting process such that the multilayer knitted fabric does not require additional stitching to maintain structural integrity; wherein the fire barrier layer provides flame-retardant and/or flame-resistant properties to the entire fabric without requiring fabric coatings or treatments to provide any contribution to flame retardance or resistance.

18. The upholstered article ofclaim 17, wherein the fire barrier layer further comprises flame-resistant fibers.

19. The upholstered article of claim 17, wherein the fire barrier layer further comprises substantially non-burning, char-forming, flame retardant fibers.

20. The upholstered article of claim 17, wherein the fabric has a maximum heat release rate of 200 kW within first five minutes of testing in accordance with ASTM E 1537 testing.

21. The upholstered article of claim 17, wherein the fabric when applied to the article has a total energy release of 25 MJ within first five minutes of testing in accordance with ASTM E 1537 testing.

22. The upholstered article of claim 17, wherein the upholstered article is selected from the group consisting of: chair, sofa, chaise, ottoman, stool, headboard, wall covering, office wall divider, transportation seating, and combinations thereof.

23. The upholstered article of claim 17, wherein the fabric farther includes a decorative outside layer.

* * * * *